US006004891A

United States Patent [19]

Tuppin et al.

[11] Patent Number: 6,004,891

[45] Date of Patent: Dec. 21, 1999

[54] COMPOSITE FABRIC, IN PARTICULAR FOR HAND LUGGAGE OR CLOTHES

[75] Inventors: Laurent Tuppin, Saint Quentin Fallavier; Alain Gallais, Paris, both of France

[73] Assignee: La Chemise Lacoste (S.A.), Paris, France

[21] Appl. No.: 09/029,790

[22] PCT Filed: Jul. 9, 1997

[86] PCT No.: PCT/FR97/01241

§ 371 Date: Apr. 23, 1998

§ 102(e) Date: Apr. 23, 1998

[87] PCT Pub. No.: WO98/01046

PCT Pub. Date: Jan. 15, 1998

[30] Foreign Application Priority Data

Jul. 9, 1996 [FR] France ..... 96 08829

[51] Int. Cl.[6] ..... D03D 13/00

[52] U.S. Cl. ..... 442/208; 442/2; 442/5; 442/49; 442/181; 442/189; 442/203; 442/204; 442/209; 442/212; 442/213; 139/408; 139/416

[58] Field of Search ..... 442/2, 5, 49, 181, 442/189, 203, 204, 208, 209, 212, 213; 139/408, 416

[56] References Cited

U.S. PATENT DOCUMENTS

| | | | |
|---|---|---|---|
| 3,862,877 | 1/1975 | Camden | 161/57 |
| 4,143,197 | 3/1979 | Jasionowicz et al. | 428/225 |
| 5,136,723 | 8/1992 | Aldridge et al. | 2/81 |
| 5,385,774 | 1/1995 | Cramer et al. | 428/247 |

FOREIGN PATENT DOCUMENTS

| | | |
|---|---|---|
| 0202183 | 5/1986 | European Pat. Off. . |
| 0569849 | 5/1993 | European Pat. Off. . |

*Primary Examiner*—Terrel Morris
*Assistant Examiner*—Ula C. Ruddock
*Attorney, Agent, or Firm*—Duane, Morris & Hecksher, LLP

[57] ABSTRACT

The composite fabric comprises a load-carrying grid disposed between cloth and a flexible layer that are held to each other, the load-carrying grid which is at least two-directional being made up at least of warp thread and weft thread which are held to one another, the mesh defined by the grid having openings of area greater than the area of the gaps defined by the texture of the decorative cloth, the decorative cloth being held directly to the flexible sheet through the mesh of the load-carrying grid such that the fabric prevents outer ribs due to the thickness of the weft threads.

10 Claims, 2 Drawing Sheets

COMPOSITE FABRIC, IN PARTICULAR FOR HAND LUGGAGE OR CLOTHES

The present invention relates to a composite fabric, suitable for various applications, in particular for obtaining and making garments, and hand baggage, such as bags or suitcases.

BACKGROUND OF THE INVENTION

Baggage is known in which the wall(s) are constituted by cloth and which has the advantage of being lighter in weight than baggage made of other materials. The cloth used by certain baggage manufacturers is obtained by warp and weft weaving of threads made of polyester and/or polyamide. They are strong in the warp and the weft directions and they present good resistance to surface abrasion. However, their strength on the bias and their resistance to shearing or to tearing from a tear-starter are unsatisfactory. When the cloth is torn because of accidental puncturing, the tear can extend along the entire length of the baggage, particularly during successive handling operations (stations, airports), or merely under the pressure exerted by the objects contained inside the baggage.

Also, various textile laminates are already known and commercially available, in particular for technical or industrial type applications, which laminates comprise an outer layer, one (or more) reinforcing layer(s), and a flexible inner layer, with the reinforcing threads, in particular aramid threads, that make up a reinforcing layer lying between the outer layer and the flexible inner layer.

However, those known laminates are reinforced by including reinforcing fibers that are hidden, whereas the present invention relates to composite fabrics made up of a load-carrying grid that provides strength against mechanical forces applied diagonally relative to the fabric, covered on both sides by layers appropriate for protecting the contents. This fabric presents characteristics and properties that are adapted more particularly to making hand baggage with a flexible wall, such as a flexible travel bag or case, where it is desirable to have walls that are lightweight but strong. Such fabric must not only withstand tearing, it must also present other qualities, in particular concerning feel and waterproofing.

OBJECTS AND SUMMARY OF THE INVENTION

According to the invention, a composite fabric made up of three superposed layers including a woven outer layer comprises: a grid that is two-directional at least, made up of held-together crossed threads of high tenacity, having a diameter greater than the thickness of the woven layer; an abrasion-resistant outer decorative cloth; and a waterproof flexible inner layer; the decorative cloth being held directly to the flexible layer through the mesh of the grid, such that the fabric includes protecting ribs in the woven layer.

According to another characteristic of the invention, at least some of the threads of the grid extend obliquely relative to the others and relative to the threads of the outer cloth, thereby constituting a polygonal mesh.

The grid is made from at least one thread having strength characteristics enabling the grid to oppose any tear that might begin in the decorative cloth; the open area of the mesh constituted by the grid is greater than that of the gaps present in or defined by the texture of the outer decorative cloth.

The composite fabric of the invention also presents the flexibility and the resistance to abrasion and shock that are required by the intended application. It possesses good strength in traction diagonally to the warp and weft threads of the decorative cloth. In addition, any accidental tear in the decorative cloth is stopped by the projecting adjacent threads of the grid so that any such tear remains limited in extent.

BRIEF DESCRIPTION OF THE DRAWINGS

Other characteristics and advantages of the invention appear from the following description of an embodiment given purely by way of non-limiting example, and with reference to the accompanying drawings, in which.

MORE DETAILED DESCRIPTION

Figure 1:
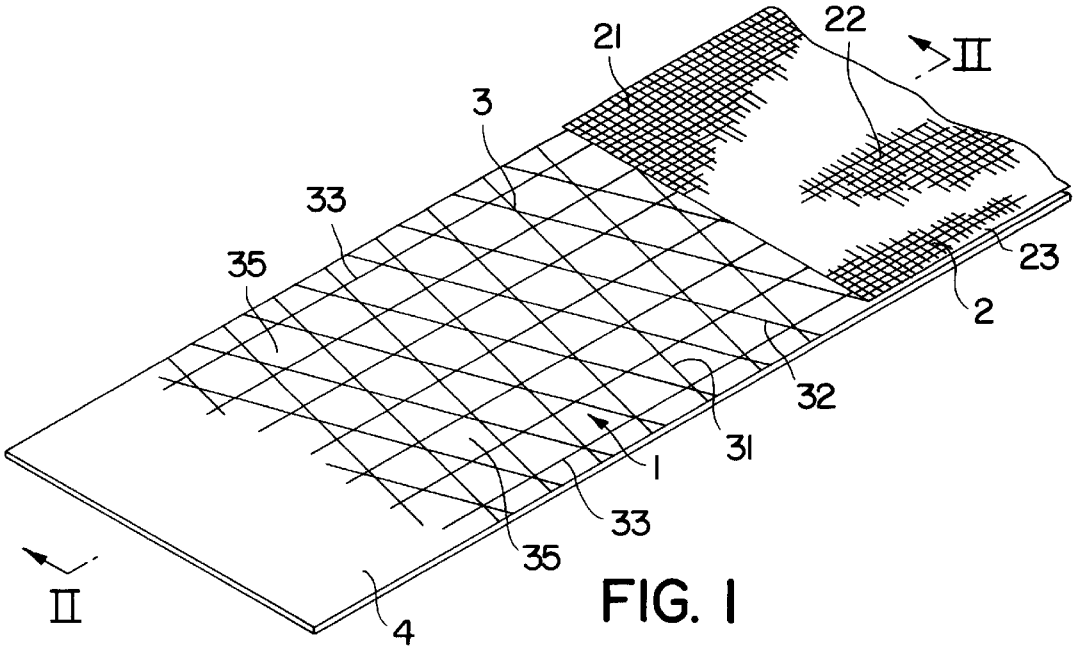
FIG. 1 is a cut-away view of a composite fabric of the invention.
Figure 2:
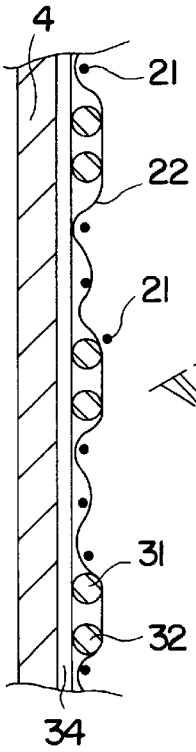
FIG. 2 is a section view through the fabric shown in FIG. 1.
Figure 3:
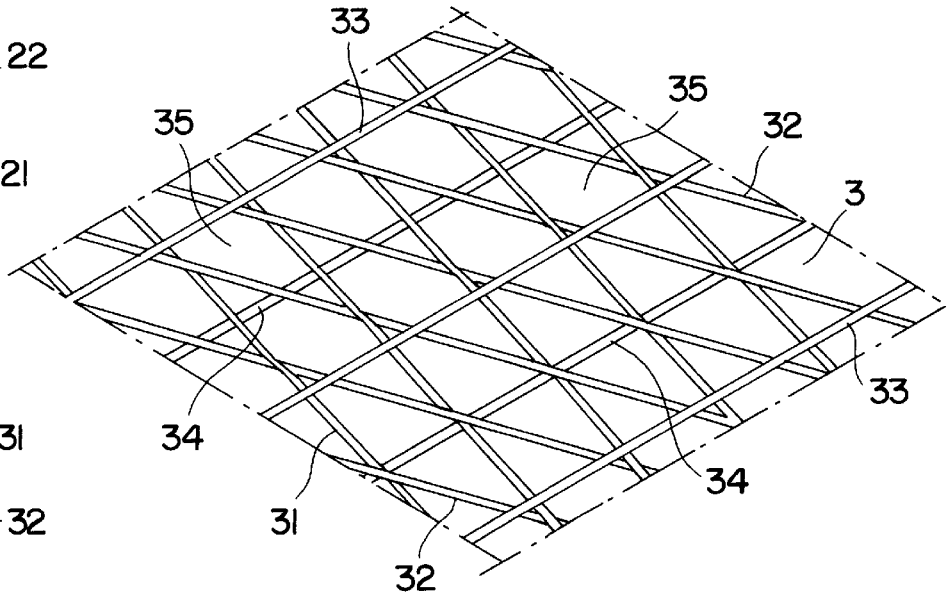
FIG. 3 is a perspective view of the load-carrying grid shown in FIG. 1.

As shown in FIGS. 1 and 2, a composite fabric of the invention comprises, bonded together or secured to one another: a decorative outer cloth 2; a load-carrying grid 3; and an inner flexible layer 4, e.g. made of PVC, together with waterproof lining, the load-carrying grid being disposed between the decorative cloth and the flexible layer.

The texture or structure of the outer decorative layer 2 imparts good resistance to abrasion thereto. For example, it may be made of 280 decitex polyester threads made up at about 30×25 threads per centimeter (30 warp and 25 weft). The mass per unit area is 180 grams per square meter ($g/m^2$). The reinforcement is preferably mock leno weave so that the cloth has an appearance that is close to that of net mesh even though it is made by using two-directional structure warp and weft technology providing traction strength in two perpendicular directions.

The cloth may also be a knit or any other structure assembling together warp threads 21 and weft threads 22 in any appropriate weave. The thread(s) of the decorative cloth are constituted by traditional substances such as natural or synthetic fibers. In addition to its decorative function, the purpose of this cloth is to protect the aramid threads since they are sensitive to abrasion.

The load-carrying grid 3 is three-directional. It may be knitted. In the example described with reference to FIGS. 1 to 4, it comprises various threads 31 to 34 assembled to one another so that they are held together, each thread having strength characteristics (and in particular traction strength) suitable for giving the grid the property of stopping any tear that might be started in the decorative cloth 2.

In the load-carrying grid 3, there can be seen:

parallel warp threads 33 and 34 which hold the grid 3; and weft threads 31 and 32 extending obliquely relative to the warp threads and defining between them a lozenge-shaped polygonal mesh 35; the shape of the mesh may thus be square, rectangular, or triangular, depending on the mutual disposition of the weft threads and on the disposition of the weft threads relative to the warp threads.

All of the threads are held relative to one another. The warp threads 33 and 34 may be different from the weft threads, the warp threads being of polyester, for example, while the weft threads are of aramid. The aramid grid provides strength against tearing insofar as the laminate becomes delaminated on tearing. Spots of adhesion break and the now loose aramid threads group together, thus braking further propagation of a tear even better. The grid thus constitutes a structure that is open and deformable in spite of adhesion.

Figure 4:
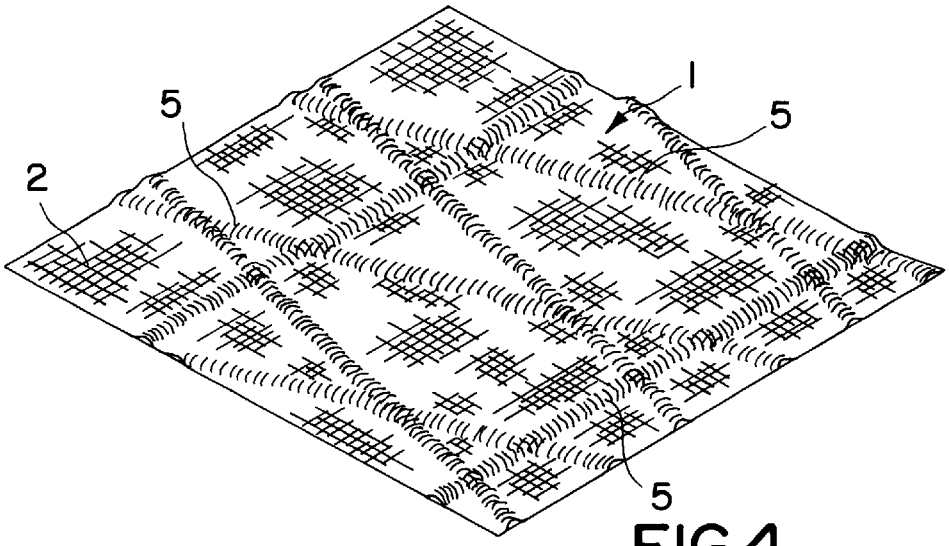
FIG. 4 shows the outside face of composite fabric of the present invention.

The weft threads 31 and 32 are much coarser than the warp threads 33 and 34 so only the weft threads 31 and 32 stand out in relief through the decorative cloth 2 (FIG. 4).

For example, the warp threads 33 and 34 may be 140 decitex polyester at two threads per cm, and the aramid weft threads 31 and 32 may be coarser than 1100 decitex, e.g. being 1580 or 1670 dtex, with twist greater than or equal to sixty turns per meter. The weft is two-directional at an angle of about 22° and with 0.5 threads per cm in each direction. The ratio of the diameters of the warp threads and of the weft threads lies in the range three to twelve. Where necessary, the parallel warp threads 33 and 34 can be omitted. The aramid threads 31, 32 have high tenacity (greater than 200 centiNewtons/tex) and a large elongation modulus (greater than 60 Gigapascals), breaking elongation being less than 4%.

The weave of the load-carrying grid is selected so that the mesh 35 of the grid has an aperture of area greater than that of the gaps 23 in the decorative outer cloth 2, overlap of the two meshes being impossible.

The diameter of the grid threads 31 and 32 is at least five times greater than the diameter of the threads 21 and 22 of the decorative cloth 2.

As shown clearly in FIG. 1, the load-carrying grid 3 is located relative to the decorative cloth 2 in such a manner that at least the warp threads 33 and 34 and/or the weft threads 31 and 32 of the grid are at an orientation that is different from the orientation of the warp and weft threads 21 and 22 of the decorative cloth 2, e.g. being oblique relative thereto.

The above-described three-directional grid 3 also makes it possible to provide better stability on the bias of the decorative cloth 2.

The inner flexile layer 4, e.g. a sheet of elastomer material such as PVC, for example, is waterproof. By way of example, it is 0.3 mm thick. As shown in particular by FIG. 2, but also in FIG. 4, the decorative cloth 2 is held directly to the flexible layer 4 through the mesh 35 of the load-carrying grid 3 so that the resulting fabric includes projecting ribs 5 in the decorative cloth 2 corresponding to the weft threads 31 and 32 of the load-carrying grid, with the warp threads 33 and 34 being practically invisible.

The flexible layer 4 is held to the decorative cloth 2 by any appropriate technique or method, e.g. by adhesive, coating, or calendaring, so as to give all of the components of the fabric an integrated structure imparting characteristics thereto which are superior to those of any of the components of the fabric. The threads of the grid show very little at the inside surface 3.

Figure 5:
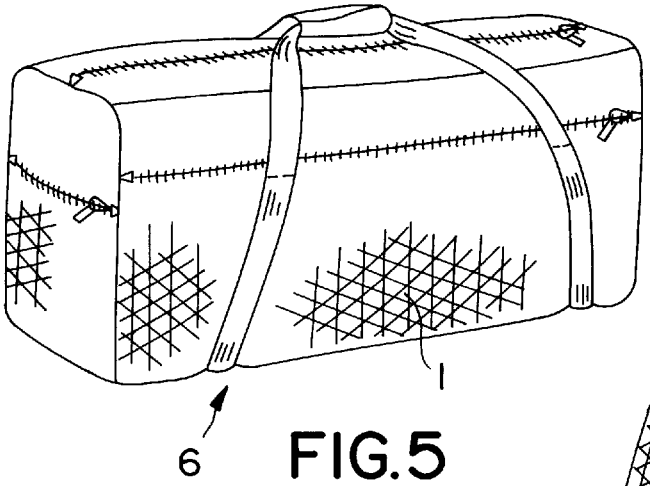
FIG. 5 is a diagram of an article of hand baggage made from fabric of the invention.
Figure 6:
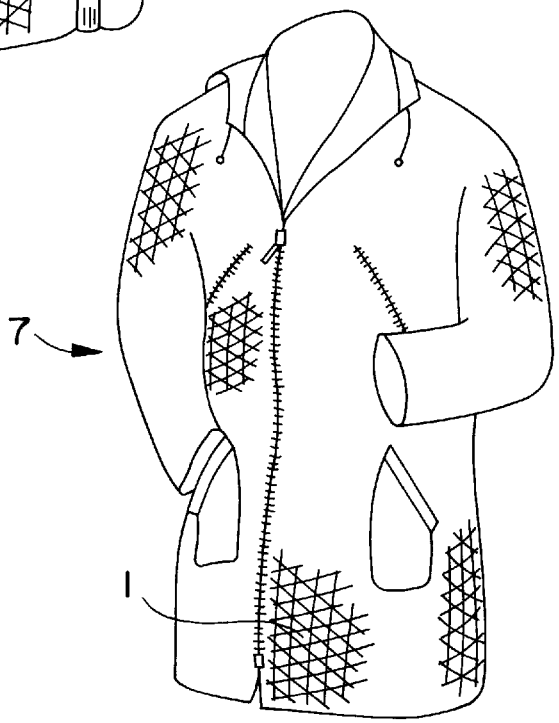
FIG. 6 is a diagram of a garment made from fabric of the invention.

As shown in FIGS. 5 and 6, this fabric can be used for hand baggage 6 or garments 7, which means that the fabric is suitable for being worked like any conventional cloth.

In these applications, the above-described composite fabric provides two essential advantages:

good traction strength in the diagonal direction, which is particularly important for baggage; and stopping any tears in a short distance, which is important both for a garment and for baggage.

We claim:

1. A composite fabric constituted by three superposed layers including a woven outer layer, the fabric comprising:

a grid that is two-directional at least, made up of held-together crossed threads of high tenacity, having a diameter greater than the thickness of the woven outer layer such that the fabric includes protecting ribs in the woven outer layer;

an abrasion-resistant outer decorative cloth; and a waterproof flexible inner layer;

the decorative cloth being held directly to the flexible layer through the mesh of the grid.

2. A composite fabric according to claim 1, wherein at least some of the weft threads of the grid extend obliquely relative to the warp threads and relative to the threads of the outer cloth, constituting a polygonal mesh, said threads being held to one another.

3. A composite fabric according to claim 2, wherein the warp threads are made of polyester, while the weft threads are made of aramid.

4. A composite fabric according to claim 2, wherein the diameter of the weft threads is at least three times greater than the diameter of the warp threads.

5. A composite fabric according to claim 1, wherein the decorative outer cloth is of warp and weft structure being made of threads that withstand abrasion, such as polyester threads.

6. A composite fabric according to claim 5, wherein the warp threads of the grid are made of polyester, while the weft threads of the grid are made of aramid, and wherein the weft threads of the grid are inclined relative to the warp threads and/or the weft threads of the outer cloth.

7. A composite fabric according to claim 1, wherein the diameter of the threads of the grid is at least five times greater than the diameter of the threads of the decorative outer cloth.

8. A composite fabric according to claim 1, wherein the inner layer is bonded to the outer layer by adhesive, coating, or calendaring through the mesh of the grid.

9. Hand baggage made using composite fabric according to claim 1.

10. A garment comprising composite fabric according to claim 1.

* * * * *